US009173036B2

(12) United States Patent
Jin

(10) Patent No.: US 9,173,036 B2
(45) Date of Patent: Oct. 27, 2015

(54) MANUFACTURING METHOD FOR NARROW-TYPE DIAPHRAGM AND THIN-TYPE DIAPHRAGM, SPEAKER-USE DIAPHRAGM MANUFACTURED USING SAME MANUFACTURING METHOD, SPEAKER, ELECTRONIC APPARATUS, AND MOVABLE DEVICE

(71) Applicant: Panasonic Corporation, Osaka (JP)

(72) Inventor: Yohei Jin, Mie (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/267,680

(22) Filed: May 1, 2014

(65) Prior Publication Data

US 2014/0241565 A1 Aug. 28, 2014

Related U.S. Application Data

(63) Continuation of application No. PCT/JP2012/008358, filed on Dec. 27, 2012.

(30) Foreign Application Priority Data

Jan. 25, 2012 (JP) ..... 2012-012699

(51) Int. Cl.

| | |
|---|---|
| ***H04R 9/04*** | (2006.01) |
| ***H04R 9/06*** | (2006.01) |
| ***H04R 7/04*** | (2006.01) |
| ***H04R 9/02*** | (2006.01) |
| ***H04R 31/00*** | (2006.01) |
| *H04R 9/00* | (2006.01) |
| *H04R 7/00* | (2006.01) |

(Continued)

(52) U.S. Cl.

CPC ..... *H04R 9/025* (2013.01); *H04R 7/04* (2013.01); *H04R 31/003* (2013.01); *H04R 2307/021* (2013.01)

(58) Field of Classification Search

USPC ..... 181/169, 167; 381/423, 426, 428

See application file for complete search history.

(56) References Cited

U.S. PATENT DOCUMENTS 5,149,486 A * 9/1992 Baba ..... 264/553
5,180,785 A * 1/1993 Uryu et al. ..... 525/240

(Continued)

FOREIGN PATENT DOCUMENTS

GB 1290972 A * 9/1972
JP 01-269394 10/1989
JP 03-092099 4/1991

(Continued)

OTHER PUBLICATIONS

International Search Report of PCT Application No. PCT/JP2012/008358 dated Apr. 2, 2013.

*Primary Examiner* — Edgardo San Martin
(74) *Attorney, Agent, or Firm* — Panasonic Patent Center

(57) ABSTRACT

After beaten, pulp is mixed with a filler to obtain a mixture of the pulp and the filler. Additives are added to the mixture, which is made into pater and then hot-pressed. The filler content of the mixture is in the range of 20 wt % to 80 wt %. After the additives are added, a polymeric viscosity improver with high viscosity is added to produce a narrow diaphragm or a thin compact diaphragm with high aspect ratio. These diaphragms have high rigidity and a wide reproduction frequency range.

15 Claims, 4 Drawing Sheets

(51) Int. Cl.
*D21H 17/00* (2006.01)
*D21H 21/00* (2006.01)

(56) References Cited

U.S. PATENT DOCUMENTS 8,855,357 B2 * 10/2014 Kajihara et al. ..... 381/428
8,873,793 B2 * 10/2014 Jin et al. ..... 381/426

FOREIGN PATENT DOCUMENTS

JP 10-131086 5/1998
JP 2000-324591 11/2000
JP 2006-042148 2/2006
JP 2007-005992 1/2007
JP 2008-160640 7/2008
JP 2009-021899 1/2009

* cited by examiner

MANUFACTURING METHOD FOR NARROW-TYPE DIAPHRAGM AND THIN-TYPE DIAPHRAGM, SPEAKER-USE DIAPHRAGM MANUFACTURED USING SAME MANUFACTURING METHOD, SPEAKER, ELECTRONIC APPARATUS, AND MOVABLE DEVICE

BACKGROUND

1. Technical Field

The present technical field relates to a method of manufacturing a narrow diaphragm or a thin diaphragm used in various audio and video devices, and also relates to a loudspeaker, an electronic apparatus, and a device each of which includes the narrow or thin diaphragm.

2. Background Art

Conventional loudspeaker diaphragms are used in cone-type electrodynamic loudspeakers and have the shape of a circle or a rectangle with an aspect ratio of 5 or less. These diaphragms are manufactured from paper which is made from wood or non-wood pulp. In the paper-making step, a filler and an impregnant are added to the pulp. The filler content is controlled to be not more than 20 wt % or so.

SUMMARY

The present disclosure is directed to provide a method of manufacturing a narrow diaphragm or a thin diaphragm containing 20 wt % or more of a filler. In this manufacturing method, a polymeric viscosity improver with high viscosity is added to a mixture of pulp and the filler in a paper-making step so that the pulp and the filler can be entangled effectively and uniformly.

This configuration extends the reproduction frequency range of the narrow diaphragm or the thin diaphragm.

DETAILED DESCRIPTION OF PREFERRED EMBODIMENTS

First Exemplary Embodiment

Conventional narrow diaphragms with high aspect ratio and conventional compact diaphragms for mobile devices have the disadvantage of a narrow reproduction frequency range. The various embodiments have an object of providing a method of manufacturing a narrow diaphragm with high aspect ratio or a thin compact diaphragm for mobile devices in such a manner that these diaphragms have a wide reproduction frequency range.

Figure 1:
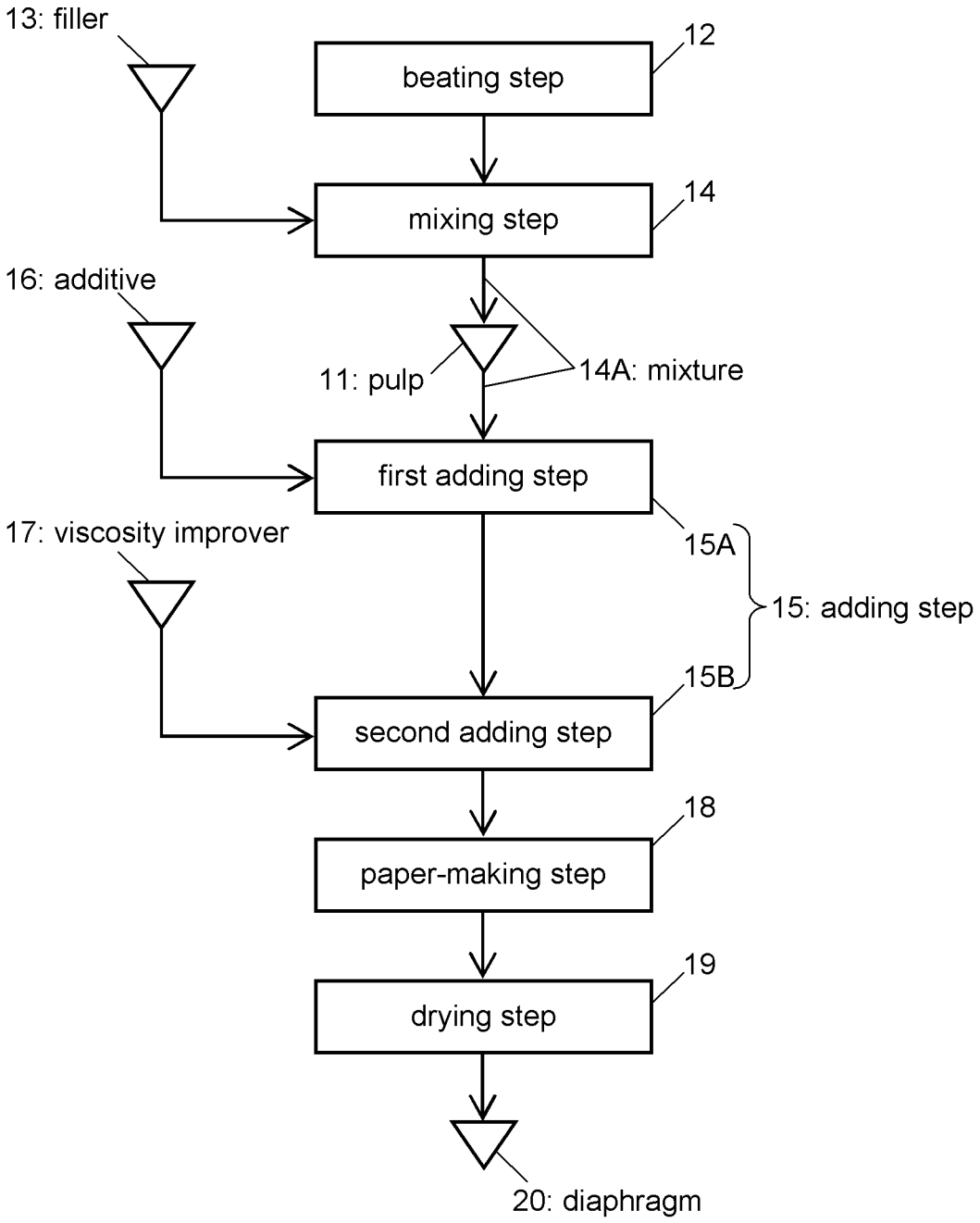
FIG. 1 is a flowchart of manufacturing a diaphragm according to a first exemplary embodiment.

The first exemplary embodiment will now be described with reference to drawings. FIG. 1 is a flowchart of manufacturing a loudspeaker diaphragm according to the first exemplary embodiment. A method of manufacturing a narrow diaphragm (hereinafter, slim diaphragm 21) and a thin compact diaphragm for mobile devices (hereinafter, micro-loudspeaker diaphragm 31) includes beating step 12, mixing step 14, adding step 15, paper-making step 18, and drying step 19. Hereinafter, slim diaphragm 21 and micro-loudspeaker diaphragm 31 are collectively referred to as diaphragm 20.

Beating step 12 is a step of fibrillating pulp 11. Mixing step 14, subsequent to beating step 12, is a step of mixing filler 13 with pulp 11 fibrillated in beating step 12, thereby forming mixture 14A of pulp 11 and filler 13.

Adding step 15, subsequent to mixing step 14, is a step of adding additives 16 and viscosity improver 17 to the mixture of pulp 11 and filler 13, thereby forming a slurry. Paper-making step 18, subsequent to adding step 15, is a step of making the slurry into paper. Drying step 19, subsequent to paper-making step 18, is a step of hot-pressing the paper.

In mixing step 14, the content of filler 13 in the mixture of pulp 11 and filler 13 is in the range of 20 wt % to 80 wt %, inclusive.

Adding step 15 includes first adding step 15A and second adding step 15B. In first adding step 15A, additives 16 such as a paper-strengthening agent and a sizing agent are added to the mixture of pulp 11 and filler 13. In second adding step 15B, subsequent to first adding step 15A, polymeric viscosity improver 17 with high viscosity is added to the mixture of pulp 11 and filler 13.

As mentioned above, viscosity improver 17 added to the mixture of pulp 11 and filler 13 in second adding step 15B allows the slurry formed in paper-making step 18 to be more viscous. This makes it less likely that filler 13 with high specific gravity precipitates by its own weight in paper-making step 18. In addition, viscosity improver 17, which is a polymer compound, has a large molecular weight to be readily entangled with pulp 11 and filler 13. As a result, filler 13 is homogeneously dispersed in the slurry in spite that its content exceeds 20 wt %. This slurry is made into paper, the use of which allows diaphragm 20 to have high rigidity and hence a wide reproduction frequency range, especially at high frequencies. This configuration provides a thin loudspeaker and a loudspeaker with high aspect ratio which customers want.

Fibrillated pulp 11 contains fine pulp, which is well fixed to the fibers of pulp 11 with the aid of viscosity improver 17. In the case of using a dye as an additive in adding step 15, the dye can be well fixed to the fibers of pulp 11. As a result, a less amount of the dye or the fine pulp is drained in paper-making step 18. This facilitates the after-treatment and reuse of the drainage water used in paper-making step 18.

Figure 2:
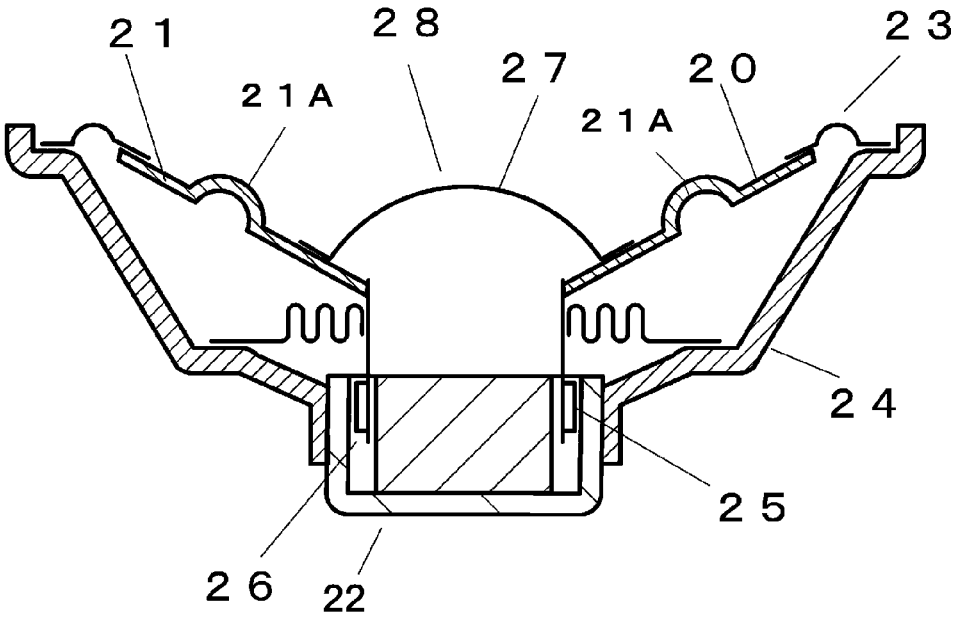
FIG. 2 is a sectional view of a loudspeaker of a first example according to the first exemplary embodiment.
Figure 3:
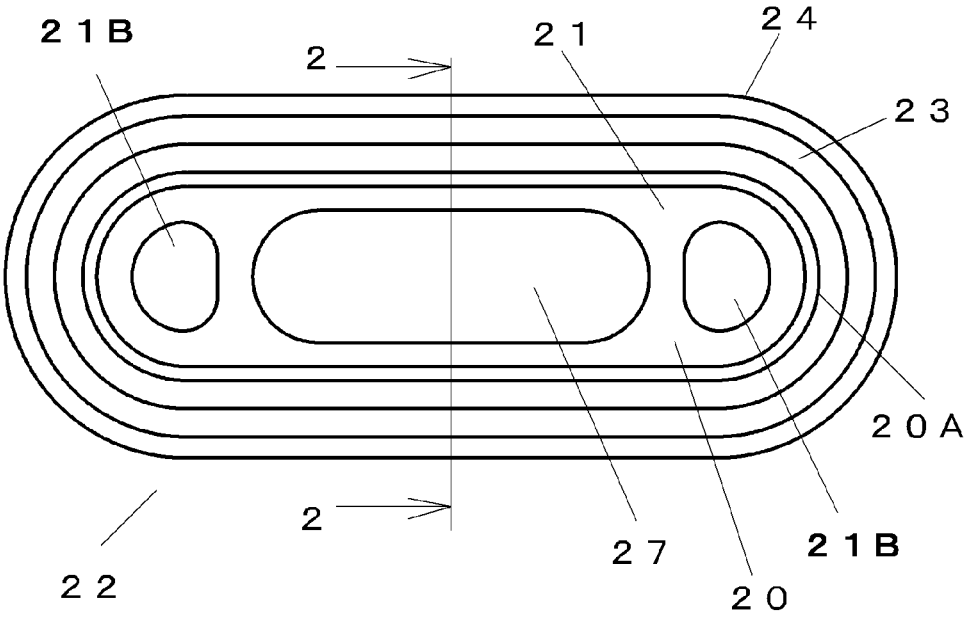
FIG. 3 is a top view of the loudspeaker of the first example according to the first exemplary embodiment.

The following is a detailed description of diaphragm 20 manufactured according to the method of the present exemplary embodiment. FIG. 2 is a sectional view of a loudspeaker of a first example according to the first exemplary embodiment, and FIG. 3 is a top view of the loudspeaker of the first example. The sectional view of FIG. 2 shows the loudspeaker of the first example taken along line 2-2 shown in FIG. 3.

Slim diaphragm 21 in the present example is elongated and has an aspect ratio of over 5 and up to 10 or so. The loudspeaker of the present example (hereinafter, slim loudspeaker 28) is elongated and has an aspect ratio of over 5 and up to 10 or so. Slim loudspeaker 28 includes cone-type slim diaphragm 21, magnetic circuit 22, edge 23, frame 24, voice coil 25, magnetic gap 26, and dust cap 27.

Magnetic circuit 22 is fixed with frame 24 at a bottom thereof. Slim diaphragm 21, on the other hand, is connected to the peripheral of a top end of frame 24 via rubber edge 23. In other words, edge 23 connects slim diaphragm 21 to frame 24.

Voice coil 25 is fixed slim with diaphragm 21 at a center thereof and is disposed in magnetic gap 26 formed in magnetic circuit 22. Magnetic circuit 22 is of internal magnet type in the present example, but may alternatively be of external magnet type or a combination of internal and external magnet types.

Slim diaphragm 21 is much longer in the longer (longitudinal) direction than in the shorter (lateral or width) direction. More specifically, slim diaphragm 21 of the present example has an aspect (longitudinal/lateral) ratio of over 5 and up to 10 or so. Slim diaphragm 21 is race track-shaped in the present example, but may alternatively be, for example, rectangular or oval.

Slim diaphragm 21 is manufactured according to the method of the present exemplary embodiment. Thus, slim diaphragm 21 has a small width and a large aspect ratio. In addition, slim diaphragm 21 has high rigidity, and hence, a wide reproduction frequency response. As a result, slim loudspeaker 28 including slim diaphragm 21 has a wide reproduction frequency response.

Slim diaphragm 21 has corrugation 21A, or alternatively, has damping-material-coated portions 21B at portions where split resonance may occur. This configuration suppresses generation of split resonance in slim diaphragm 21, and hence, generation of peak-dip due to the resonance. As a result, slim diaphragm 21 provides a flat sound pressure-frequency response in a wide reproduction frequency range.

Edge 23 is made of a highly flexible material, so that slim diaphragm 21 can lower the reproduction frequencies in a low frequency region. With the above-described configuration, slim loudspeaker 28 has a wide reproduction frequency range.

Figure 4:
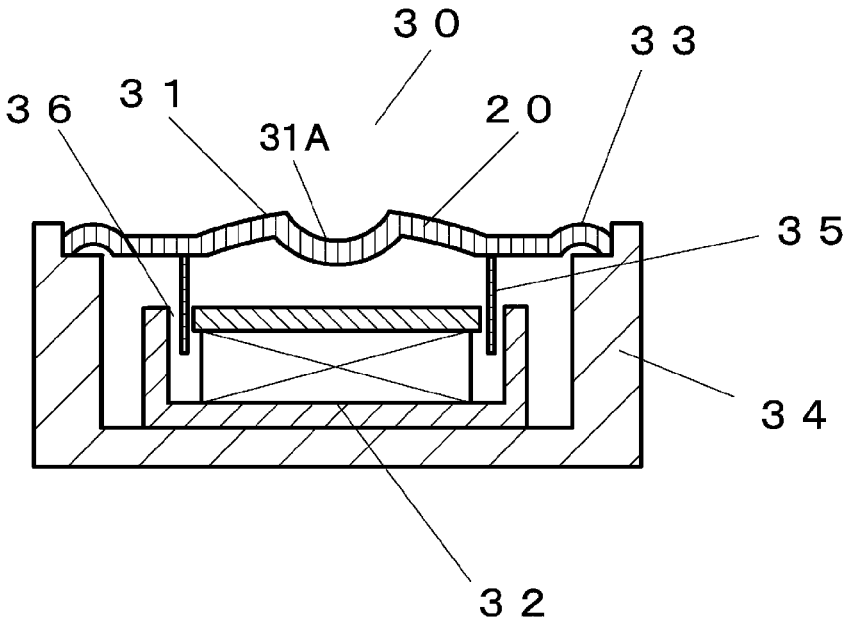
FIG. 4 is a sectional view of a loudspeaker of a second example according to the first exemplary embodiment.
Figure 5:
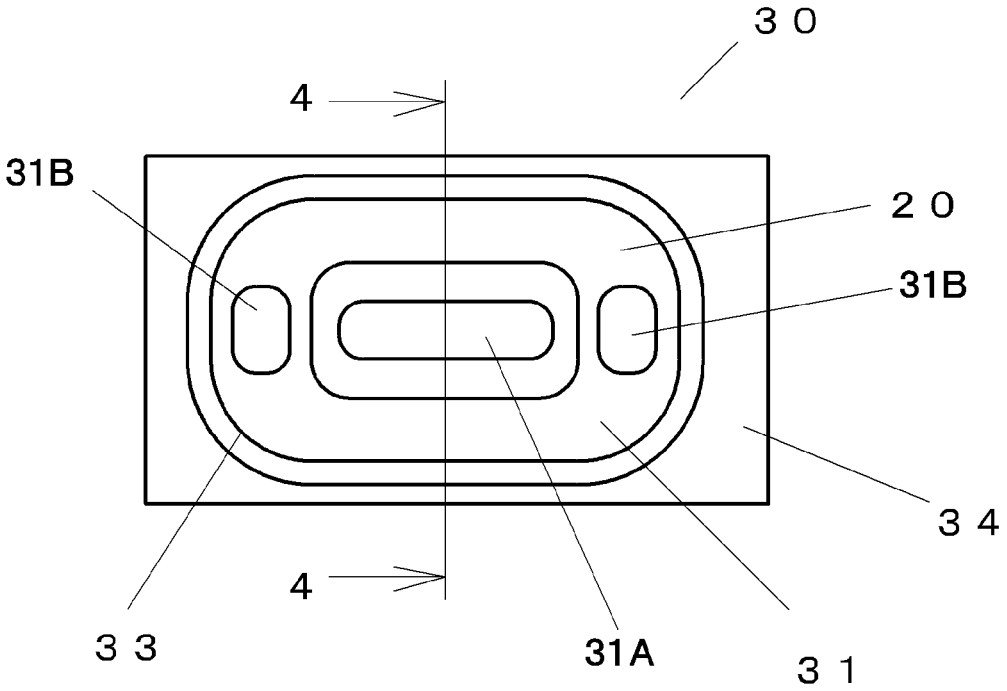
FIG. 5 is a top view of the loudspeaker of the second example according to the first exemplary embodiment.

FIG. 4 is a sectional view of a loudspeaker of a second example according to the first exemplary embodiment, and FIG. 5 is a top view of the loudspeaker of the second example. The sectional view of FIG. 4 shows the loudspeaker of the second example taken along line 4-4 of FIG. 5.

Micro-loudspeaker diaphragm 31 in the present example is a dome-shaped thin diaphragm, and is used in a thin compact mobile loudspeaker (hereinafter, micro-loudspeaker 30). Micro-loudspeaker 30, which is to be mounted in a compact portable device such as a mobile phone, is thin and compact. Micro-loudspeaker 30 includes dome-shaped micro-loudspeaker diaphragm 31, magnetic circuit 32, edge 33, frame 34, voice coil 35, and magnetic gap 36.

Magnetic circuit 32 is fixed at a center of frame 34. Micro-loudspeaker diaphragm 31 is connected to the peripheral of a top end of frame 34 via edge 33. In other words, edge 33 connects micro-loudspeaker diaphragm 31 to frame 34.

Voice coil 35 is fixed with micro-loudspeaker diaphragm 31 at a center thereof and is disposed in magnetic gap 36 formed in magnetic circuit 32. Magnetic circuit 32 is of internal magnet type in the present example, but may alternatively be of external magnet type or a combination of internal and external magnet types.

Micro-loudspeaker diaphragm 31, which is to be mounted in a mobile phone or other similar device, is very compact. Micro-loudspeaker diaphragm 31 mounted in a mobile phone is generally about 10 mm in the longer (longitudinal) direction and about mm in the shorter (lateral) direction. Furthermore, micro-loudspeaker diaphragm 31 is very thin, namely, has a thickness of about 0.1 mm in the present example.

Micro-loudspeaker diaphragm 31 is manufactured according to the method of the present exemplary embodiment. Thus, micro-loudspeaker diaphragm 31 is thin, light, and highly rigid. As a result, micro-loudspeaker diaphragm 31 has a wide reproduction frequency response, so that micro-loudspeaker 30 has a wide reproduction frequency response.

Micro-loudspeaker diaphragm 31 has corrugation 31A, or alternatively, has damping-material coated portions 31B at portions where split resonance may occur. This configuration suppresses generation of split resonance in micro-loudspeaker diaphragm 31, and hence, generation of peak-dip due to the resonance. As a result, micro-loudspeaker diaphragm 31 provides a flat sound pressure-frequency response in a wide reproduction frequency range.

Edge 33 is made of a highly flexible material, so that micro-loudspeaker diaphragm 31 can lower the reproduction frequencies in a low frequency region. With the above-described configuration, micro-loudspeaker 30 has a wide reproduction frequency range.

The following is a more detailed description of the method of manufacturing diaphragm 20 according to the present exemplary embodiment. Pulp 11 used in the present exemplary embodiment is made from wood or non-wood fibers. Examples of the wood used for pulp 11 include coniferous and broadleaf trees. Examples of the non-wood used for pulp 11 include bamboo, bamboo grass, kenaf, jute, bagasse, Manila hemp, and gampi. From these fibers, the most appropriate one or ones can be chosen for the tone control of diaphragm 20.

When made of wood fibers, diaphragm 20 has large internal loss, and hence, provides warm tones. When made of non-wood fibers, on the other hand, diaphragm 20 promotes the saving of limited wood resources.

Since bamboo fibers are very hard, diaphragm 20 including pulp 11 made from bamboo fibers is highly rigid. Furthermore, bamboos grow fast, thereby suppressing deforestation and an increase in carbon dioxide levels. Moreover, bamboos can be obtained stably and continuously for industrial use because they grow fast and in many regions. As another advantage, diaphragm 20 including pulp 11 mainly made from bamboo can be incinerated. Thus, unlike diaphragms containing inorganic materials such as grass fibers, diaphragm 20 including pulp 11 mainly made from bamboo fibers does not need to be landfilled, thereby promoting global environmental protection.

The bamboo fibers used as pulp 11 are obtained from bamboos of one year old or more. In general, bamboos continue to grow for 50 days and almost stop growing after that. Therefore, the fibers of bamboos of one year old or more are stable in physical properties such as the hardness of the fibers. When made from the fibers of bamboos of one year old or more, diaphragm 20 has stable acoustic characteristics. Furthermore, bamboos grow fast enough not to deplete bamboo forests even if they are harvested at one year old or more. For this reason, bamboo fibers can be obtained continuously and stably.

Bamboo fibers contain lignin in their surfaces, which inhibits the adhesion between bamboo fibers due to its hydrogen bonding properties. To reduce the inhibition, the lignin content of the bamboo fibers is made 20 wt % or less. In this case, the bamboo fibers can adhere to each other, thereby enabling diaphragm 20 to have large internal loss. In diaphragm 20 with a high content of filler 13 as in the present exemplary embodiment, the bamboo fibers contained therein compensate the decrease in internal loss due to filler 13. As a result, diaphragm 20 produces extremely fascinating sounds.

Filler 13 may be made, for example, of mica, plant opal, or metal fiber, one of which can be selected to achieve a desired sound quality. Filler 13 can have a higher affinity for pulp 11 by being subjected to a silane treatment, thereby increasing the effects of tone control. The mica used as filler 13 may be either natural or synthetic, and preferably has a high aspect ratio. This allows diaphragm 20 to have higher rigidity and a wider reproduction frequency range. The plant opals used as filler 13 may be made from rice plant, bamboo, Japanese silver grass, Japanese barnyard millet, reed, or corn. Examples of the metal fiber used as filler 13 include stainless steel, aluminum, and ceramic can be used as filler 13.

Beating step 12 is a step of beating (fibrillating) pulp 11. Pulp 11 is beaten by using a grinding mill or a single-, double- or multi-axis kneader. Examples of the grinding mill include a mixer, a beater, and a refiner. In beating step 12, pulp 11 can be beaten with a medium such as glass beads.

In beating step 12, it is crucial to control the beating degree of pulp 11 according to Canadian standard freeness (hereinafter, referred to simply as the beating degree). The beating degree of pulp 11 in beating step 12 is in the range of 200 ml to 700 ml, inclusive. When the beating degree is less than 200 ml, the filtration rate is low in paper-making step 18, causing diaphragm 20 to be manufactured with very low productivity. When, on the other hand, the beating degree is more than 700 ml, the fibers of pulp 11 are not well entangled with each other in diaphragm 20, and hence, diaphragm 20 has low rigidity.

As described above, by setting the beating degree of pulp 11 in the range of 200 ml to 700 ml, inclusive, pulp 11 effectively functions as the aggregate to form diaphragm 20, enabling diaphragm 20 to have appropriate rigidity. In addition, flocs are prevented from formation, and hence, uneven papermaking is less likely to occur in paper-making step 18 in the manufacture of diaphragm 20.

Pulp 11 has a fiber length not less than 0.8 mm and not more than 3 mm. When the fiber length is short, pulp 11 does not have its own strength, especially when it is less than 0.8 mm. When the fiber length is not less than 0.8 mm, diaphragm 20 is highly rigid. When, on the other hand, the fiber length is not more than 3 mm, the fibers of pulp 11 are prevented from being entangled too much with each other. In other words, this suppresses a decrease in the dispersibility of pulp 11 in the diaphragm, making it less likely that diaphragm 20 has a defective appearance when completed.

As described above, as the fiber length of pulp 11 is in a range from 0.8 mm to 3 mm, inclusive, the strength of pulp 11 itself can be maintained. Therefore, pulp 11 functions as the aggregate of diaphragm 20, and hence, diaphragm 20 has sufficient rigidity. In addition, uneven papermaking is less likely to occur in the manufacture of diaphragm 20.

Mixing step 14 is subsequent to beating step 12. In mixing step 14, fibrillated pulp 11 and filler 13 are put in water to produce mixture 14A of pulp 11 and filler 13. The content of pulp 11 in mixture 14A in mixing step 14 is in the range of 20 wt % (80 wt % of filler 13) to 80 wt % (20 wt % of filler 13). When the content of pulp 11 in mixture 14A is less than 20 wt %, the amount of pulp 11 to be entangled with filler 13 is not enough to make diaphragm 20 sufficiently rigid. When, on the other hand, the content of filler 13 in mixture 14A is less than 20 wt %, the amount of filler 13 is not enough to make diaphragm 20 have a desired rigidity, and hence, a desired reproduction range. By setting the content of pulp 11 in the above-mentioned range in mixing step 14, diaphragm 20 has a density in the range of 0.40 g/cm$^3$ to 1.00 g/cm$^3$. As a result, diaphragm 20 has the intrinsic properties of paper such as vibration-damping properties and lightness.

When the density of diaphragm 20 is 0.40 g/cm$^3$ or more, diaphragm 20 has significantly high strength, thereby suppressing abnormal noises due to generation of split resonance at high frequencies.

Resin diaphragms are large in weight; in general, they have a density of 1.00 g/cm$^3$ or so. Diaphragm 20 has a small weight because its density is not more than 1.00 g/cm$^3$. The lightness, which is one of the features of diaphragm 20 made of paper, can be made the best use of to reduce the deterioration of characteristics such as a sound pressure decrease.

In mixing step 14, it is possible to add synthetic fiber besides filler 13. Synthetic fiber increases the internal loss of diaphragm 20, and hence, the vibration-damping properties of diaphragm 20, thereby preventing diaphragm 20 from being distorted in shape and sound. Examples of the synthetic fiber include polyester fiber, polyolefin fiber, acrylic fiber, aramid fiber, vinylon fiber, rayon fiber, nylon fiber, and PEN fiber.

In adding step 15, additives 16 and viscosity improver 17 are added to mixture 14A. Adding step 15 includes first adding step 15A and second adding step 15B subsequent to first adding step 15A. In first adding step 15A, additives 16 such as a paper-strengthening agent and a sizing agent are added to mixture 14A. In second adding step 15B, viscosity improver 17 is added to mixture 14A containing additives 16.

Viscosity improver 17 increases the viscosity of the slurry containing pulp 11 and filler 13, and improves the dispersibility of pulp 11 and filler 13 in mixture 14A. Viscosity improver 17 can be made of either a cationic or zwitterionic material. As a result, the affinity between pulp 11 and filler 13 is improved.

The larger molecular weight of viscosity improver 17 is, the higher viscosity of the slurry becomes. Therefore, a polymer compound with a molecular weight of 5,000,000 or more is used as viscosity improver 17. Viscosity improver 17 used in the present example is polyacrylamide with a molecular weight of 5,000,000. Thus, viscosity improver 17 with a large molecular weight allows different materials with different specific gravities to be homogeneously dispersed in mixture 14A. The use of such viscosity improver 17 thus improves the entanglement between pulp 11 and filler 13 in water. In addition, the homogeneous dispersion of pulp 11 and filler 13 prevents strength variations from place to place in diaphragm 20. Therefore, diaphragm 20 can provides a flat sound pressure-frequency response.

Pulp 11 and viscosity improver 17 have smaller specific gravities than that of filler 13. In addition, the specific gravity difference between pulp 11 and viscosity improver 17 is smaller than that between viscosity improver 17 and filler 13. This means that pulp 11 and viscosity improver 17 have similar specific gravities and are easily mixed with each other. Furthermore, viscosity improver 17 has a viscosity of 12,000 mPa·s at 25° C. or greater. As the viscosity of viscosity improver 17 is high, it is less likely that filler 13 with high specific gravity precipitates by its own weight. These features facilitate the more homogeneous dispersion of pulp 11 and filler 13 in mixture 14A.

Viscosity improver 17 used in the present example is water-soluble polyacrylamide. The water-soluble polyacrylamide is dispersed much more homogeneously in water, allowing pulp 11 and filler 13 to be dispersed much more homogeneously in mixture 14A.

As described above, the viscosity and molecular weight of viscosity improver 17 are important factors for the homogeneous dispersion of pulp 11 and filler 13. In other words, it is important how much of pulp 11 and filler 13 viscosity improver 17 is entangled in water. Therefore, the added amount of viscosity improver 17 is in the range of 0.1 to 5 parts by weight of the total weight of pulp 11 and filler 13. When the added amount of viscosity improver 17 is 0.1 parts by weight or more, mixture 14A has sufficient viscosity. This allows pulp 11 and filler 13 to be sufficiently dispersed in water; in other words, this makes it less likely that filler 13 is dispersed insufficiently in mixture 14A and that diaphragm 20 has a defective appearance. When, on the other hand, the added amount of viscosity improver 17 is 5 parts by weight or less, the slurry is not too viscous. This suppresses a decrease in the ease of removing water from mixture 14A in paper-making step 18, thereby allowing diaphragm 20 to be manufactured with high productivity.

Examples of additives 16 used in first adding step 15A include a fixing agent, a wet strengthening agent, a dry strengthening agent, a sizing agent, and a chemical agent with water or oil repellency. The fixing agent is used to fix a dye or a pigment to diaphragm 20. Considering the compatibility with the pulp, it is preferable that the fixing agent be made of a polyamine-based cationic material. A wet strengthening agent can be used to provide diaphragm 20 with strength in wet conditions. Preferable examples of the wet strengthening agent include urea formaldehyde resin, melamine-formaldehyde resin, and polyamidepolyamine-epichlorohydrin. The dry strengthening agent is used to provide diaphragm 20 with sufficient strength after diaphragm 20 is dried in drying step 19. Preferable examples of the dry strengthening agent include a cationized starch, and cationic and anionic polyacrylamides. The sizing agent is used to provide ink-bleeding. Considering the fixing property of the sizing agent to pulp 11, it is preferable that the sizing agent be made of a cationic material.

It is also possible to add aluminum sulfate to mixture 14A in order to adjust the pH of the slurry. In this case, these examples of additives 16 can be well fixed to pulp 11.

In paper-making step 18, the slurry which contains additives 16 and viscosity improver 17 added in adding step 15 is made into paper using a paper-making mold. The paper-making mold is shaped exactly like diaphragm 20. In paper-making step 18, the dye and fine pulp (for example, fine fiber described later) can be efficiently fixed to the fibers of pulp 11 because of viscosity improver 17 added in adding step 15. The water drained from paper-making step 18 is made dust-free, and is reused in beating step 12. In the above-described manufacturing method, less amounts of the dye and fine pulp are drained in paper-making step 18. This facilitates the after-treatment and reuse of the drainage water used in paper-making step 18.

Paper-making step 18 may include the step of applying a damping material to portions of diaphragm 20 where split resonance may occur. The damping material makes diaphragm 20 have less split resonance, and hence, less peak-dip due to the resonance. As a result, diaphragm 20 provides a flat sound pressure-frequency response in a reproduction frequency range.

In drying step 19 subsequent to paper-making step 18, the paper is hot-pressed to remove water therefrom and then is molded so as to complete diaphragm 20 with a desired thickness.

The internal loss of diaphragm 20 tends to decrease in proportion to the content of filler 13 in mixing step 14. Therefore, drying step 19 may include the formation of corrugation 21A (shown in FIGS. 2 and 3) and corrugation 31A (shown in FIGS. 4 and 5) on diaphragm 20 in order to increase the internal loss of diaphragm 20. This configuration allows diaphragm 20 to have less split resonance, and hence, less peak-dip due to the resonance. As a result, diaphragm 20 provides a flat sound pressure-frequency response in a wide reproduction frequency range.

Drying step 19 may include the step of impregnating diaphragm 20 with resin. The impregnant (resin) impregnated into diaphragm 20 functions as a sound-controlling material. In other words, the sound quality of diaphragm 20 can be controlled according to the type or amount of the impregnant. The impregnant can be polyester or acrylic. The resin with which diaphragm 20 is impregnated may be engineering plastic or plant-derived resin. One example of the plant-derived resin is polylactic acid, which is biodegradable, thereby suppressing carbon dioxide emissions from incineration and promoting global environmental protection.

It is alternatively possible to impregnate diaphragm 20 with flame-retardant resin so as to make it flame retardant, and hence, excellent both in sound quality and reliability. The flame-retardant resin can be arbitrarily selected from bromine-, phosphorus-, antimony-, and inorganic-based flame retardants. Examples of the bromine-based flame retardant include tetrabromobisphenol A (TBBA), decabromodiphenyl ether (Deca-BDE), and hexabromocyclododecane (HBCD). Examples of the phosphorus-based flame retardant include tricresyl phosphate, an aromatic phosphate ester, an aromatic condensed phosphate ester, and polyphosphates. Examples of the antimony-based flame retardant include antimony trioxide, antimony tetroxide, antimony pentoxide, and sodium antimonate. Examples of the inorganic-based flame retardant include aluminum hydroxide and magnesium hydroxide.

Diaphragm 20 is impregnated with the sound-controlling material and the flame retardant in drying step 19, but the sound-controlling material and the flame retardant may alternatively be added to mixture 14A in either mixing step 14 or adding step 15. In this case, viscosity improver 17 also has the function of homogeneously dispersing the sound-controlling material and the flame retardant into mixture 14A. Viscosity improver 17 reduces the amount of the sound-controlling material and the flame retardant to be drained in paper-making step 18. This allows the sound-controlling material and the flame retardant to be fully effective in diaphragm 20.

Furthermore, a resin laminate and a resin film can be used as the sound-controlling material. The resin laminate or the resin film is attached to diaphragm 20 either after or instead of impregnating diaphragm 20 with resin. By attaching the resin laminate or the film to diaphragm 20, its sound quality can be controlled to be high. The resin laminate or the film is attached to one of the front and back sides of diaphragm 20. The resin laminate and film may be made from PP, PE, PET, PEN, PEI, or PI. These sound-controlling materials can be used to improve the sound quality of diaphragm 20.

In beating step 12, pulp 11 may be more finely fibrillated to obtain fine fibers. If the fine fibers is used to form diaphragm 20, the rigidity of diaphragm 20 can be improved further. Alternatively, it is possible to mix pulp 11, the fine fibers, and filler 13 together in mixing step 14. As a result, slim diaphragm 21 and micro-loudspeaker diaphragm 31 can have a wider reproduction frequency response.

The fine fibers may be made from wood such as coniferous and broadleaf trees or non-wood such as bamboo, kenaf, hemp, jute, and bagasse. The fine fibers may alternatively be bacterial cellulose, which is produced by a bacterium typified by an acetic acid bacterium. Other examples of the fine fibers include Acetobacter aceti, Acetobacter xylinum, Acetobacter rancens, Sarcina ventriculi, and Bacterium xyloides.

Beating step 12 for obtaining the fine fibers is performed using a grinding mill, a pressure homogenizer, or a single-, double- or multi-axis kneader. Examples of the grinding mill include a mixer, a beater, and a refiner. If needed, it is possible to crush the fibers of pulp 11 into small fragments using a medium such as glass beads.

It is preferable that the content of the fine fibers in mixture 14A in mixing step 14 be in the range from 1 wt % to 30 wt %. In this case, the fine fibers function as a binder to tightly bond the fibers of pulp 11 to each other, thereby providing diaphragm 20 with higher rigidity. The fine fibers also function as the sealer between the fibers of pulp 11, thereby pinholes is prevented from generating in diaphragm 20. This reduces the sound pressure decrease due to pinholes, thereby improving the sound pressure of diaphragm 20.

Bamboo fibers are very rigid; adding the bamboo fibers made fine to a microfibrillar state improves the rigidity of diaphragm 20. The proper additive amount of the fine bamboo fibers in the microfibrillar state is in the range from 1 wt % to 30 wt %. When the additive amount is 1 wt % or more, diaphragm 20 can obtain the reinforcing effect from the fine bamboo fibers in the microfibrillar state. When, on the other hand, the additive amount of the fine bamboo fibers in the microfibrillar state is 30 wt % or less, mixture 14A is less likely to clog a paper-making mesh in paper-making step 18. This prevents a decrease in freeness in paper-making step 18, allowing diaphragm 20 to be manufactured with high productivity.

The beating degree in beating step 12 is set to 200 ml or less so as to obtain the fine bamboo fibers in the microfibrillar state. When made of bamboo fibers having a beating degree of 200 ml or less, diaphragm 20 has dramatically higher rigidity than when made of normal pulp 11 alone. As a result, diaphragm 20 is more rigid than conventional paper diaphragm.

Diaphragm 20 may be circular, rectangular, or oval to provide the above-described effects. Diaphragm 20 can be used not only in full-range loudspeakers, but also in woofers and tweeters. The effects of diaphragm 20 are noticeable when the aspect ratio between the longitudinal and lateral scales is high.

EXAMPLE

The following are the evaluation results of the sound quality characteristics of diaphragm 20, which is made from paper made of mixture 14A of pulp 11 and filler 13 in the ratio of 50:50. Filler 13 used in the present example is mica, which is a typical filler. Different amounts of the viscosity improver are added (namely, 0 parts by weight, 1 parts by weight, and 5 parts by weight) to mixture 14A in second adding step 15B in the present example. Table 1 shows acoustic characteristics of diaphragm 20 manufactured under the above-described conditions.

TABLE 1

| | materials and contents thereof | | | | physical properties | | |
|---|---|---|---|---|---|---|---|
| number | Pulp [wt %] | Mica [wt %] | impregnation | viscosity improver [parts by weight] | elastic modulus [MPa] | tan δ | sound speed [m/s] |
| 1 | 50 | 50 | present | 0 | 4279 | 0.029 | 2875 |
| 2 | 50 | 50 | present | 1 | 8518 | 0.022 | 3502 |
| 3 | 50 | 50 | present | 5 | 8846 | 0.022 | 3755 |

The results indicate that when 1 to 5 parts by weight of viscosity improver 17 is added, the elastic modulus of diaphragm 20 rises to levels that are about twice as high as when viscosity improver 17 is not added. As shown in Table 1, it is confirmed that the acoustic characteristics of diaphragm 20 significantly improve with the addition of viscosity improver 17.

The results show that filler 13 is homogeneously dispersed in mixture 14A even when the content of filler 13 in mixture 14A is as high as 50%. Thus, slim diaphragm 21 and micro-loudspeaker diaphragm 31 have extremely high acoustic characteristics when mixture 14A contains filler 13 in the range from 50 wt % to 80 wt %, and viscosity improver 17 is added to mixture 14A in the range from 1 to 5 parts by weight.

Second Exemplary Embodiment

Figure 6:
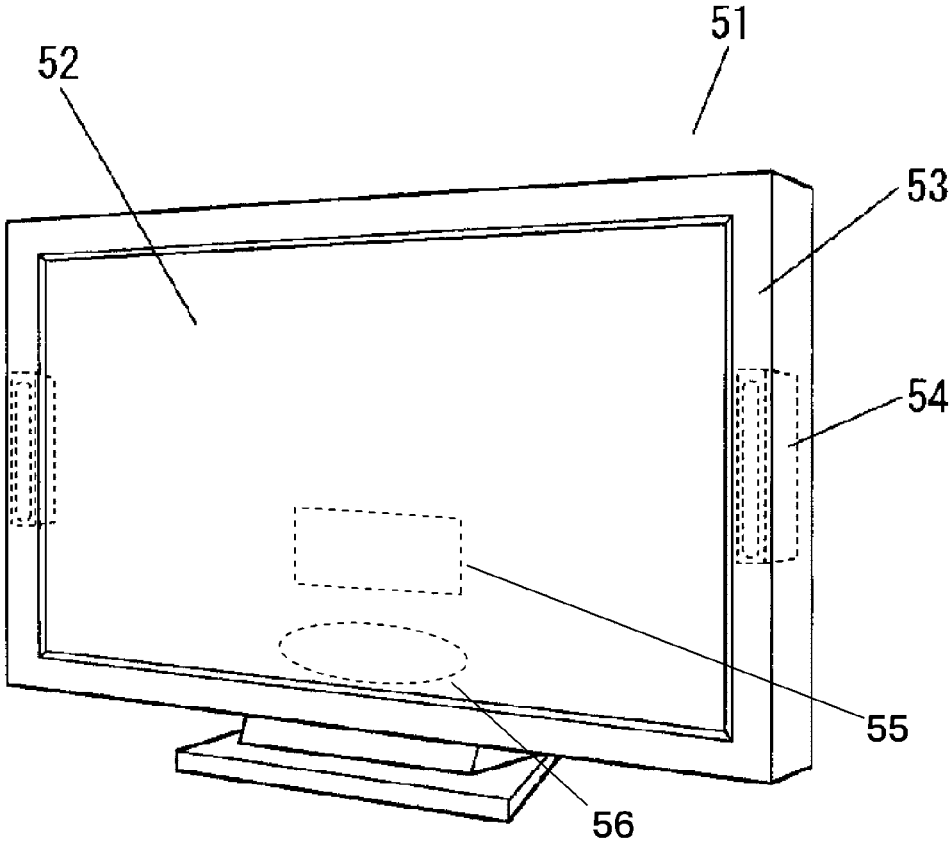
FIG. 6 is a perspective view of an electronic apparatus according to a second exemplary embodiment.

An electronic apparatus according to a second exemplary embodiment will now be described in detail as follows with reference to drawings. FIG. 6 is a perspective view of the electronic apparatus according to the second exemplary embodiment. Electronic apparatus 51 of the present exemplary embodiment includes video display unit 52, outer frame 53, and loudspeakers 54. Electronic apparatus 51 further includes bass loudspeaker 55 and signal processing circuit 56. Outer frame 53 encloses the outer periphery of video display unit 52. Loudspeakers 54 are accommodated inside outer frame 53. For example, loudspeakers 54 are installed in the right and left sides of outer frame 53.

Loudspeakers 54 used in the present example are either slim loudspeakers 28 or micro-loudspeakers 30. In the case of using slim loudspeakers 28, their longitudinal sides are oriented vertically inside electronic apparatus 51. In the case of using micro-loudspeakers 30, they are connected along their longitudinal sides inside electronic apparatus 51. In this case, the longitudinal sides of micro-loudspeakers 30 are oriented vertically inside electronic apparatus 51.

Alternatively, loudspeakers 54 may be installed in vicinities of outer periphery of the top and bottom sides of outer frame 53 in electronic apparatus 51. The longitudinal sides of loudspeakers 54 are oriented to the lateral side of electronic apparatus 51. This layout contributes the miniaturization of electronic apparatus 51.

If necessary, loudspeakers 54 may be installed in the top, bottom, right, and left sides of outer frame 53. This configuration enables loudspeakers 54 to handle high input power and to have a high sound pressure level.

Loudspeakers 54 in the present exemplary embodiment have a high reproduction frequency especially in a high frequency range by the addition of viscosity improver 17. The signal processing circuit installed in electronic apparatus 51 may be configured to allow loudspeakers 54 to receive signals in the middle- and high-frequency ranges alone. With this configuration, loudspeakers 54 can fully reproduce sounds in the middle and high frequency ranges. Since signals in the low frequency range are not supplied to loudspeakers 54, slim loudspeakers 28 and micro-loudspeaker 30 may have low maximum input power.

Electronic apparatus 51 may further include bass loudspeaker 55. Since sound in the low-frequency range has a wide directivity, bass loudspeaker 55 may be installed in a free space inside electronic apparatus 51, not necessarily in the front of electronic apparatus 51. Therefore, bass loudspeaker 55 does not hinder the downsizing of electronic apparatus 51. Signal processing circuit 56 supplies signals in a low frequency range to bass loudspeaker 55, allowing electronic apparatus 51 to reproduce sounds in a wide frequency range.

It goes without saying that electronic apparatus 51 such as an audio device of small size can be used without providing a bass loudspeaker. In this case, sounds in a low frequency range are fed to loudspeakers 54; therefore, it is better to provide the more number of loudspeakers 54. Connecting the plurality of loudspeakers 54 in parallel can reduce the level of the signal that each loudspeaker 54 receives.

Third Exemplary Embodiment

Figure 7:
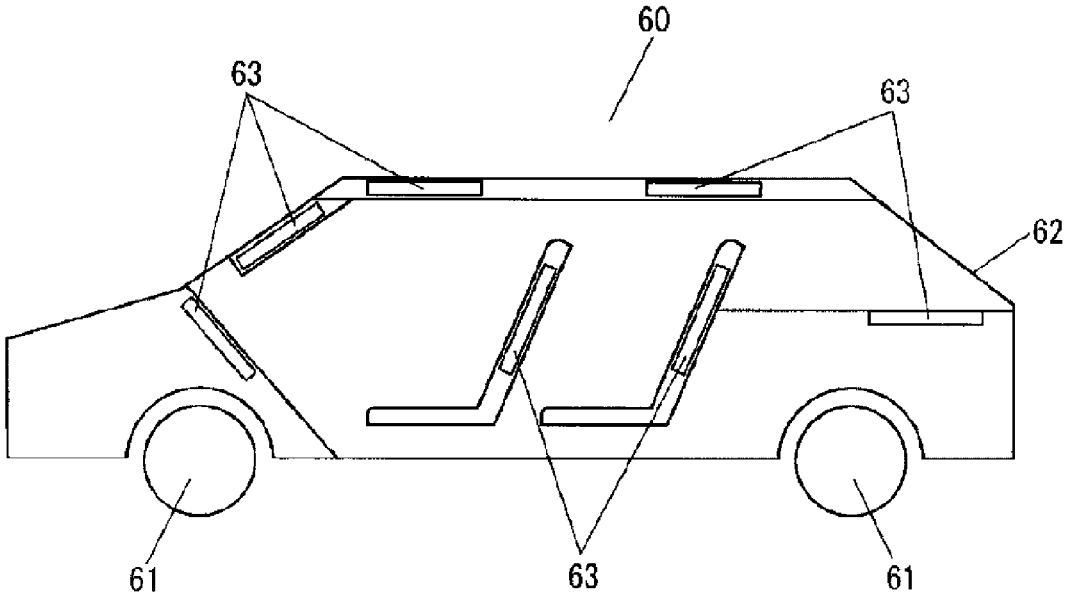
FIG. 7 is a conceptual view of a movable device according to a third exemplary embodiment.

A third exemplary embodiment will now be described in detail with reference to drawings. FIG. 7 is a conceptual view of a movable device according to the third exemplary embodiment. Automobile 60 is an example of the movable device of the present exemplary embodiment. Automobile 60 includes driving devices 61 (such as tires and an engine) and body member 62 (including a chassis, a body, an interior, and seats). Loudspeakers 63 are embedded in body member 62 at a ceiling, an instrument panel, sun visors, seats, a rear tray, or the like. Alternatively, loudspeakers 63 may be embedded in headrests, armrests, a car cockpit, mirrors, meters, a steering wheel, pillars, doors, or the like.

Loudspeakers 63 can be either slim loudspeakers 28 or micro-loudspeakers 30. In the case of using micro-loudspeakers 30, they are connected longitudinally together inside automobile 60. Slim loudspeakers 28 are very narrow, whereas micro-loudspeakers 30 are very compact. Therefore, either type of them can be easily mounted as loudspeakers 63 inside body member 62 regardless of the installation location.

It is generally preferable that loudspeakers 63 be installed so as to be near the ears of listeners, and therefore, be installed inside the front pillars. In the case of using micro-loudspeakers 30, they are connected along their longitudinal sides and are accommodated inside the front pillars. Loudspeakers 63 accommodated inside the front pillars are sufficiently narrow, thus not to affect the width of the front pillars. In other words, the width of the front pillars does not need to be increased to accommodate loudspeakers 63 inside. As a result, automobile 60 provides the driver with a wide front view.

Since the front pillars are located close to the ears of the listeners, micro-loudspeakers 30 installed in the front pillars as loudspeakers 63 can be sufficiently close to the ears of the listeners. Therefore, even if the sound pressure level of each of micro-loudspeakers 30 is comparatively small, the listeners can feel the sound pressure sufficiently. As a result, loudspeakers used in mobile phones with low sound pressure levels can be used as micro-loudspeakers 30.

With the above-described configuration, loudspeakers 63 promote the miniaturization and also contribute to the weight reduction of the movable devices such as automobile 60. Hence, loudspeakers 63 greatly contribute to the fuel consumption reduction of these movable devices.

The movable device of the present exemplary embodiment is described by taking automobile 60 as an example, but is not limited to this. Loudspeakers 63 can be mounted in any movable device such as a bicycle, motorcycle, bus, train, ship, and airplane.

The method of manufacturing a diaphragm according to the present disclosure is applicable to narrow loudspeakers or thin, light, and compact loudspeakers to be installed in electronic apparatuses such as video/audio devices and information communication devices, and automobiles.

What in claimed is:

1. A method of manufacturing a narrow diaphragm or a thin diaphragm, the method comprising, in the sequence set forth:

beating pulp;

mixing the beaten pulp with a filler so as to form a mixture of the beaten pulp and the filler;

adding a paper-strengthening agent and a sizing agent as additives to the mixture;

making paper from the mixture containing the additives; and drying the paper by hot-pressing;

wherein a content of the filler in the mixture is in a range of 20 wt % to 80 wt %, inclusive, when the mixture is formed; and a polymeric viscosity improver made of a polymeric material having a molecular weight of 5,000,000 or greater, and having a viscosity of 12,000 mPa·s/25° C. or greater is added after the additives are added and before making the paper.

2. The method according to claim 1, wherein adding the additives, an added amount of the viscosity improver is in a range of 0.1% to 5%, inclusive, of a total weight of the mixture.

3. The method according to claim 1, wherein the viscosity improver is either cationic or zwitterionic.

4. The method according to claim 1, wherein the beaten pulp has a beating degree in a range from 200 ml to 700 ml, inclusive, according to Canadian standard freeness.

5. The method according to claim 1, wherein the beaten pulp has a fiber length of not less than 0.8 mm and not more than 3 mm.

6. The method according to claim 1, wherein the diaphragm has a density in a range from 0.40 g/cm$^3$ to 1.00 g/cm$^3$, inclusive.

7. The method according to claim 1, wherein when mixing the beaten pulp and the filler, fine fibrillated fibers are mixed with the beaten pulp and the filler to form the mixture; and a content of the fine fibrillated fibers in the mixture is in a range from 1 wt % to 30 wt %, inclusive.

8. The method according to claim 7, wherein the fine fibrillated fibers have a beating degree of 200 ml or less.

9. The method according to claim 1, wherein the pulp contains bamboo fibers obtained from bamboos of one year old or more.

10. The method according to claim 9, wherein a lignin content of the bamboo fibers is 20 wt % or less.

11. The method according to claim 1, wherein the filler is at least one of mica, plant opal, and metal fiber.

12. A loudspeaker diaphragm manufactured by the method of manufacturing the narrow diaphragm or the thin diaphragm according to claim 1, wherein the filler is contained in a range from 20 wt % to 80 wt %, inclusive.

13. A loudspeaker comprising:

the loudspeaker diaphragm as defined in claim 12;

a frame;

a magnetic circuit connected to the frame;

a voice coil disposed in a magnetic gap of the magnetic circuit and fixed in a center of the loudspeaker diaphragm; and an edge joining the loudspeaker diaphragm and the frame.

14. An electronic apparatus comprising:

a video display unit;

an outer frame enclosing the video display unit; and the loudspeaker as defined in claim 13 and accommodated inside the outer frame.

15. A movable device comprising:

a driving device;

a body member including the driving device; and the loudspeaker as defined in claim 13 and mounted in the body member.

* * * * *